US007364502B2

(12) United States Patent
Ficai

(10) Patent No.: US 7,364,502 B2
(45) Date of Patent: Apr. 29, 2008

(54) CUTTING WHEEL

(76) Inventor: Giovanni Ficai, Strada Della Costa, 23, Ozzano Taro (PR) (IT) 43046

( * ) Notice: Subject to any disclaimer, the term of this patent is extended or adjusted under 35 U.S.C. 154(b) by 0 days.

(21) Appl. No.: 11/363,242

(22) Filed: Feb. 28, 2006

(65) Prior Publication Data

US 2006/0217050 A1 Sep. 28, 2006

(30) Foreign Application Priority Data

Mar. 23, 2005 (IT) ..... MO20050005 U

(51) Int. Cl.
*B24B 33/00* (2006.01)

(52) U.S. Cl. ..... 451/548; 451/540; 451/551

(58) Field of Classification Search ..... 451/548, 451/540, 541, 551
See application file for complete search history.

(56) References Cited

U.S. PATENT DOCUMENTS

| | | | | |
|---|---|---|---|---|
| 970,618 | A * | 9/1910 | Gardner | 451/548 |
| 1,641,799 | A * | 9/1927 | Brandes et al. | 451/548 |
| 2,795,903 | A * | 6/1957 | Titcomb | 451/548 |
| 2,883,807 | A * | 4/1959 | Titcomb | 451/548 |
| 3,121,299 | A * | 2/1964 | Fye | 451/548 |
| 3,292,311 | A | 12/1966 | Hensley | |
| 3,745,719 | A * | 7/1973 | Oswald | 451/548 |
| 3,889,430 | A * | 6/1975 | Scandaletos | 451/546 |
| 4,624,237 | A | 11/1986 | Inoue | |
| 5,911,620 | A * | 6/1999 | Spangenberg et al. | 451/548 |
| 6,196,911 | B1 * | 3/2001 | Preston et al. | 451/548 |
| 6,277,017 | B1 | 8/2001 | Ji | |
| 6,299,522 | B1 * | 10/2001 | Lee | 451/548 |
| 6,419,574 | B1 * | 7/2002 | Takahashi et al. | 451/548 |
| 6,551,181 | B2 * | 4/2003 | Lee | 451/548 |
| 6,726,550 | B2 * | 4/2004 | Nishihara | 451/285 |
| 6,814,657 | B2 * | 11/2004 | Spangenberg et al. | 451/548 |
| 6,890,250 | B1 * | 5/2005 | Kim et al. | 451/541 |
| 6,949,012 | B2 * | 9/2005 | Barnett, III | 451/56 |
| 2001/0011004 | A1 * | 8/2001 | Yamaguchi et al. | 451/548 |
| 2002/0178890 | A1 | 12/2002 | Okuda et al. | |

FOREIGN PATENT DOCUMENTS

| | | | |
|---|---|---|---|
| DE | 35 13 687 | A1 | 10/1986 |
| DE | 197 53 618 | A1 | 6/1999 |
| DE | 201 09 636 | | 3/2002 |
| EP | 1 050 375 | A1 | 11/2000 |
| EP | 1 481 781 | A1 | 12/2004 |
| FR | 963 496 | | 7/1950 |
| FR | 2 666 533 | | 3/1992 |
| GB | 1060405 | | 3/1967 |
| JP | 9-123064 | | 5/1997 |
| JP | 2003-53670 | | 2/2003 |

* cited by examiner

*Primary Examiner*—Eileen P. Morgan
(74) *Attorney, Agent, or Firm*—Young & Thompson

(57) ABSTRACT

The present invention relates to an improved cutting wheel, comprising a disk-shaped abrasive body having two opposite faces and a non-uniform thickness.

3 Claims, 3 Drawing Sheets

CUTTING WHEEL

The present invention relates to an improved cutting wheel.

Thin, flat and depressed center cutting wheels are known, which consist of a thin disk of abrasive material, typically molded from a mixture of granules of suitable hardness and binders, and having hole at its center, optionally reinforced, for mounting it onto a rotating spindle.

The opposite faces of these wheels are usually flat and parallel to define a constant thickness of the abrasive disk.

The forward motion imparted to the cut-off wheel is parallel to the plane of the wheel itself, thereby causing the workpiece to be cut across.

Therefore, in use, both faces of the wheel rub against the cut surfaces generated by cutting the workpiece, thereby generating high frictions, and the wheel fits in the gap defined by such surfaces, thereby making chip removal, ventilation of the working area, hence cooling, rather difficult.

These cutting wheels are susceptible of further improvements.

The specific object of this invention is to provide such improvements by proposing an improved cutting wheel that is optimized as compared with prior art, particularly in terms of versatility, resistance and quality of the cut surfaces formed on the workpieces and easier penetration in solid section cuts.

Within this technical frame, another object of the invention is to accomplish the above tasks by providing a simple structure, that ensures relatively easy practical implementation, safe use and effective operation, as well as a relatively low cost.

The above tasks and objects are all fulfilled by the present improved cutting wheel, which comprises a disk-shaped abrasive body having two opposite faces, characterized in that said body has a non-uniform thickness.

Further features and advantages of this invention will become more apparent from the detailed description of a few preferred non exclusive embodiments of an improved cutting wheel, presented by way of non illustration, and without limitation in the accompanying drawings in which.

Figure 1:
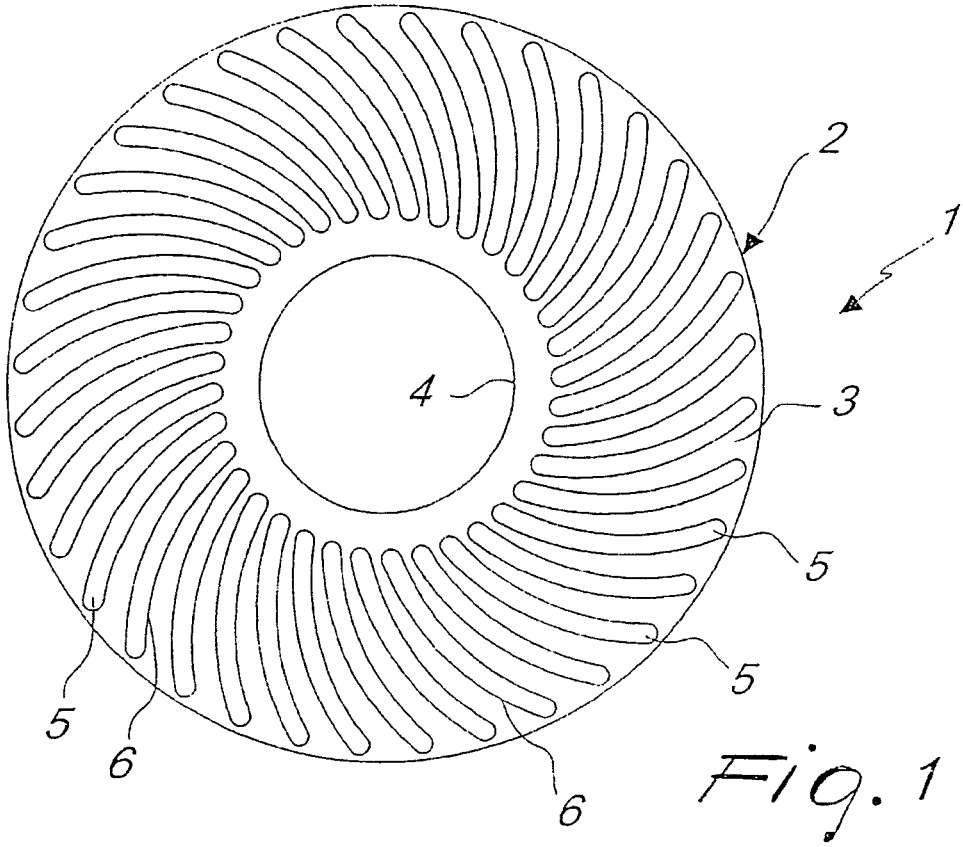
FIG. 1 is a schematic front view of a first embodiment of the wheel of the invention.

FIGS. 7*a* to 7*f* are schematic cross sectional view of a few profiles of the wheel of the invention.

Particularly referring to the above figures, an improved cutting wheel has been generally designated by numeral 1.

The wheel 1 comprises a disk-shaped abrasive body 2 having two opposite faces 3, with an aperture 4 of any shape, optionally reinforced, formed at its center, for fitting it to a conventional spindle.

According to the invention, the body 2 has a non-uniform thickness throughout its extension. Particularly, the body 2 has at least one raised profile 5 associated to at least one of the faces 3, which may be added to such face or, preferably, formed of one piece therewith, such as by molding.

This profile may be formed by a special mold cavity, which may be either empty or filled with a resilient material (e.g. rubber of any type), or by fitting smooth molds with perforated disks having special patterns to form the raised profile.

The profile 5 preferably has an elongate shape, to form a sort of rib, and has a substantially straight or curvilinear extension (arc of a circle, arc of an ellipse, or else).

The profile 5 may extend in an essentially radial direction from the face 3.

The profile 5 may connect smoothly to the surrounding portion of the face 5, to prevent impacts with the workpiece, but it may also have no smooth connection thereto.

Furthermore, it may have various shapes and sizes, in cross section throughout its length, depending on the desired aesthetical and/or functional results (e.g. performance optimization, cutting capacity). Certain possible sections of the profile 5 are shown by way of example in FIGS. 7*a* to 7*f*.

The profile 5 has a substantially constant thickness at least throughout its central portion, preferably of less than 0.001 m, and its size transverse its length and parallel to the face 3 is either substantially constant, or increasing or decreasing as it approaches the periphery of the face.

The wheel 1 advantageously has a plurality of profiles 5 arranged near the periphery of the face 3.

The profiles 5 are preferably arranged in succession, with a substantially constant angular pitch or in symmetric sets (also for balancing purposes, considering that these are high-speed rotating bodies) over an annular band of any size on face 3.

Therefore, the wheel 1 has a plurality of grooves (spaces) 6 for removing chips formed during processing and/or ventilation and cooling of the working area, which are defined between two successive profiles 5 of the above succession.

Depending on the shape of the profiles 5, the wheel 1 may have a preferred direction of rotation, for improved chip removal and enhanced cooling of the cutting area.

The wheel 1 preferably has profiles 5 associated to or made of one piece with each of the faces 3; the profiles 5 on the two faces 3 may either have matching angular phase positions or be alternated or offset through a desired angle.

The inventive conformation is particularly advantageous for wheels 1 whose diameter is of 0.05 m to 0.35 m and whose thickness is of the order of about 1/60 of the diameter, or less.

FIG. 1 shows a first embodiment of the wheel of the invention, in which the faces 3, one whereof is only visible in the figure, are shaped to define a plurality of slightly curved profiles 5, arranged in succession over an annular band. The profiles 5 are arranged over each face 3 with their convexities oriented in the same direction and with outward inclinations to the radius, either constant or not, in the direction opposite to the direction of rotation.

Figure 2:
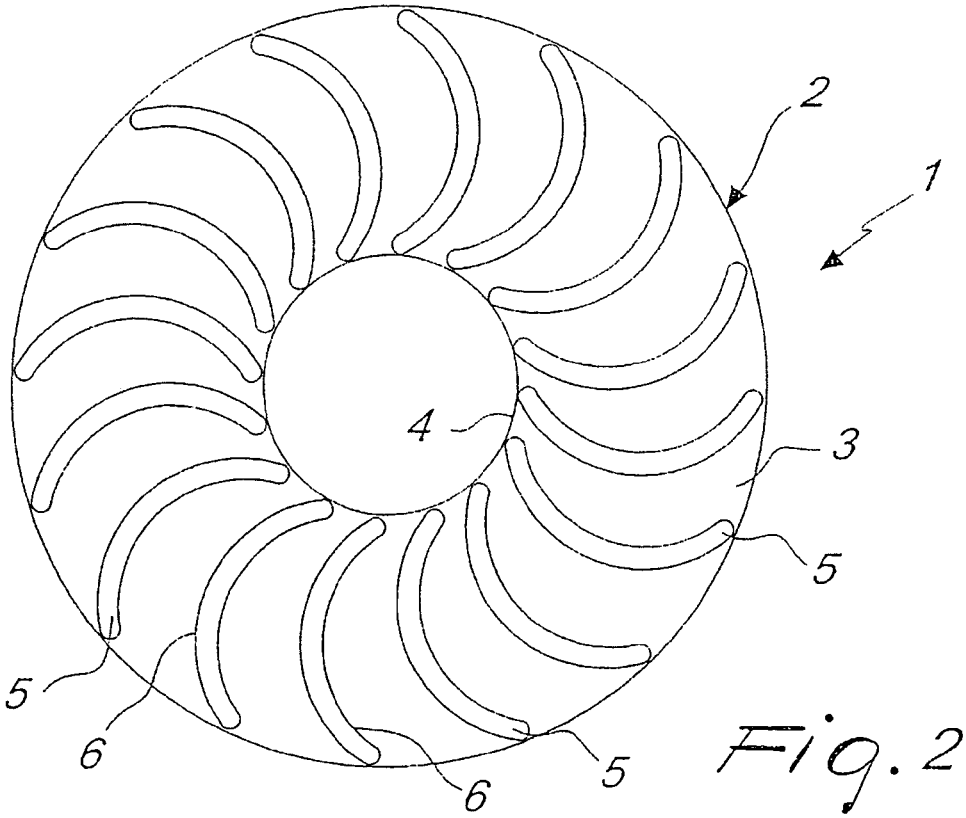
FIG. 2 is a schematic front view of a second embodiment of the wheel of the invention.

FIG. 2 shows a second embodiment of the wheel of the invention, in which the faces 3, one whereof is only visible in the figure, are shaped to define a plurality of curvilinear profiles 5, arranged in succession over an annular band. The profiles 5 are arranged over each face with their convexities oriented in the same direction, and with their ends lying on respective symmetric radial directions.

Figure 3:
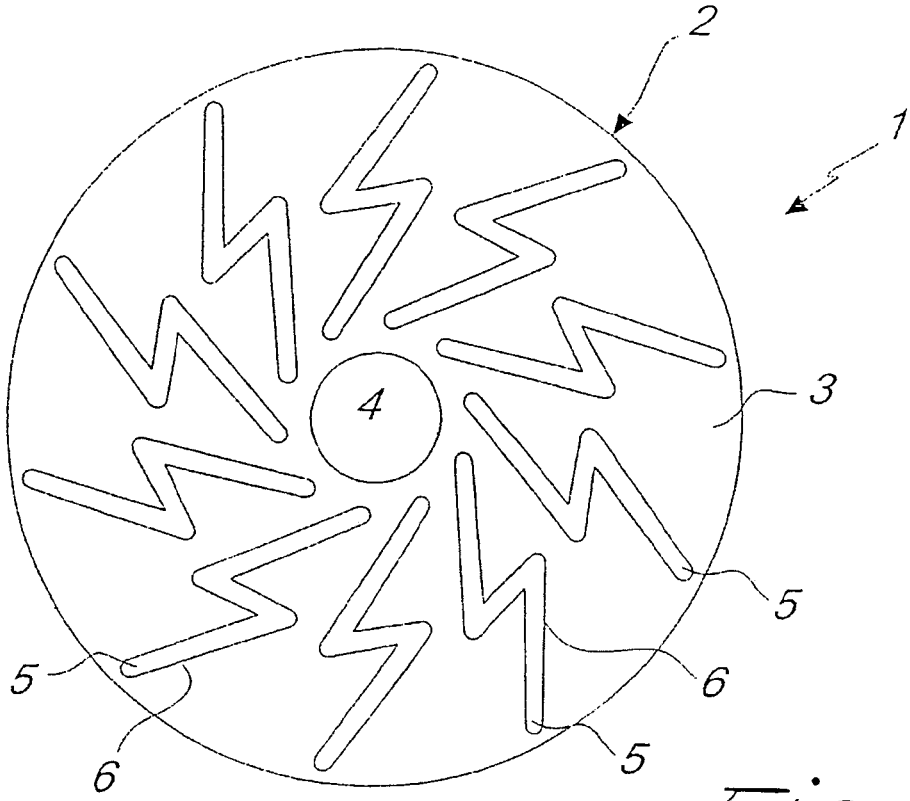
FIG. 3 is a schematic front view of a third embodiment of the wheel of the invention.

FIG. 3 shows a third embodiment of the wheel of the invention, in which the faces 3, one whereof is only visible in the figure, are shaped to define a plurality of zigzag profiles 5, extending along respective broken lines arranged in succession over an annular band.

Figure 4:
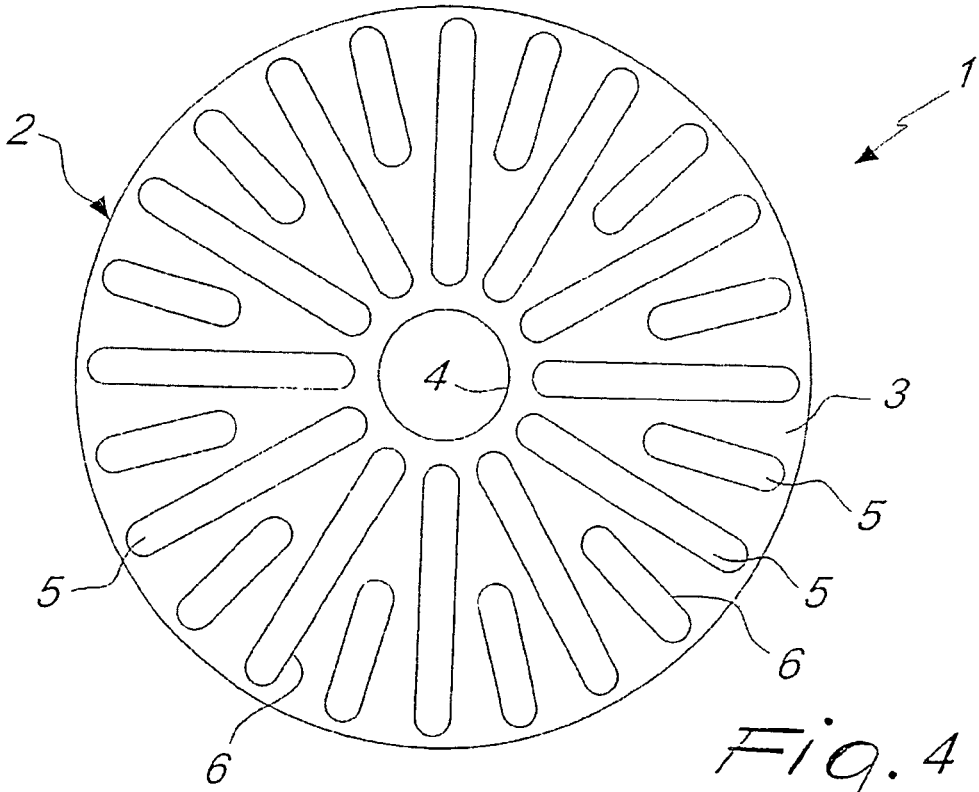
FIG. 4 is a schematic front view of a fourth embodiment of the wheel of the invention.

FIG. 4 shows a fourth embodiment of the wheel of the invention, in which the faces 3, one whereof is only visible in the figure, are shaped to define a plurality of straight profiles 5 of different lengths, inclined in respective symmetric radial directions and arranged in succession with a constant angular pitch over an annular band. The longer profiles 5 alternate with shorter profiles.

Figure 5:
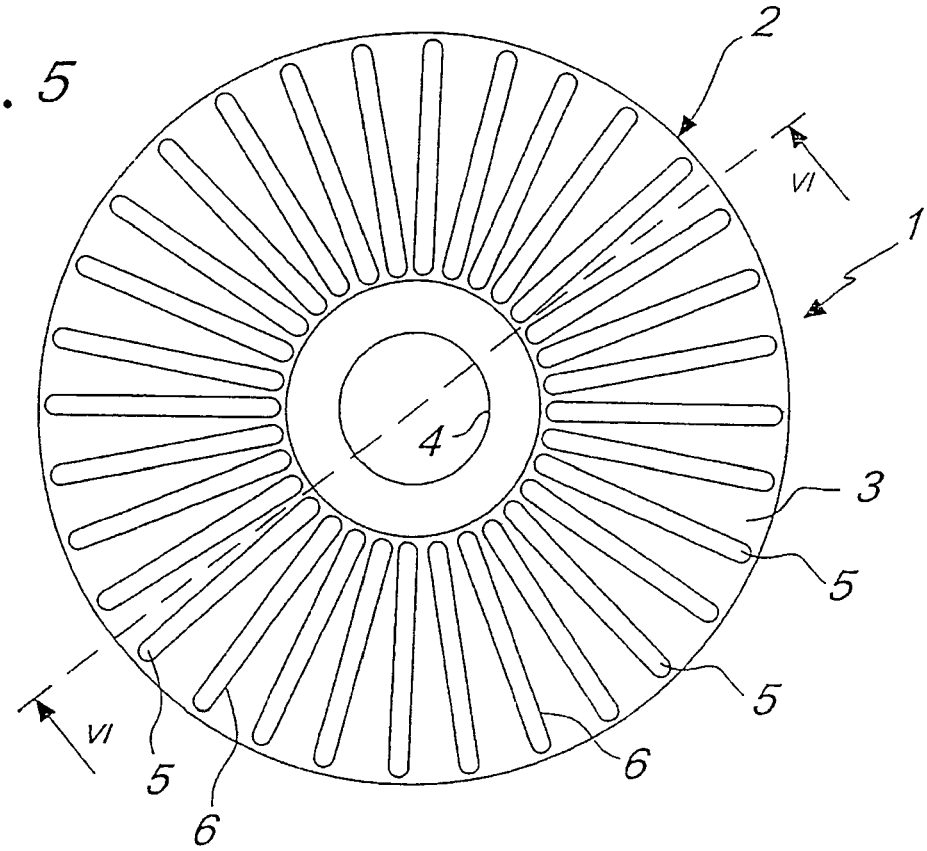
FIG. 5 is a schematic front view of a fifth embodiment of the wheel of the invention.
Figure 6:
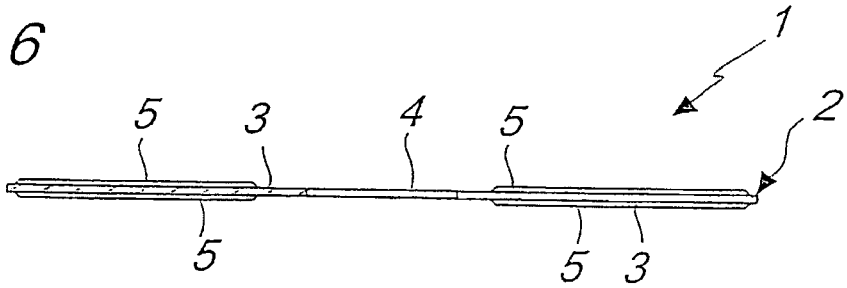
FIG. 6 is a schematic cross-sectional view as taken along plane VI-VI of FIG. 5.
Figure 7A:
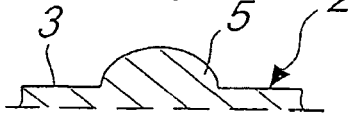
Figure 7B:
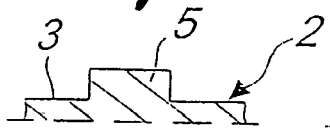
Figure 7C:
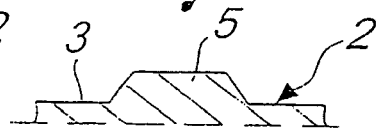
Figure 7D:
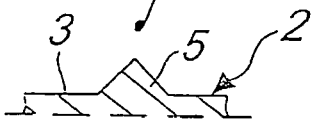
Figure 7E:
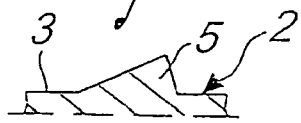
Figure 7F:
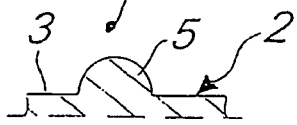

Finally, FIGS. 5 and 6 show a fifth embodiment of the wheel of the invention, in which the faces 3, one whereof is only visible in the figure, are shaped to define a plurality of straight profiles 5 of equal lengths, inclined in respective symmetric radial directions and arranged in succession with a constant angular pitch over an annular band.

The above disclosed invention was found to fulfill the intended objects.

Particularly, if the wheels are fabricated by molding, the abrasive material will have a non uniform density distribution, namely lower at the profiles, where the molding volume within the molds is larger, thereby affording a higher versatility of use in response to the various types of material to be cut. Particularly, the areas having a higher density and hardness are more effective with soft materials, whereas the areas having a lower density are more suitable for processing harder materials.

Thus, the invention so conceived provides various areas of different densities, wherein the ratio between such areas of different densities varies as required, and in view of performance optimization.

Furthermore, the provision of raised profiles allows the inventive wheels to have a higher bending strength as well as a higher lateral stability as compared with prior art wheels of equal thickness.

The invention is particularly useful in the manufacture of the very thin cutting wheels, which have been increasingly popular in recent years and that, for the diameters of 115 mm and 125 mm, are being sold with thicknesses of 0.8 mm and even less; these traditional wheels have no lateral bending strength and the invention may considerably improve such strength.

Furthermore, when such wheels are used to cut workpieces having a solid section or a large thickness, the contact area between the wheel and the faces generated by cutting the workpieces is limited to the tips of the raised profiles, which dramatically reduces friction generated heat and enhances ventilation and removal of chips from the working area through the grooves defined between the raised profiles.

Finally, it should be noted that the wheel of the invention has particularly pleasing aesthetic qualities; such qualities may be enhanced by adding color to the raised profiles or cavities, through the use of various colors or materials (plastic materials, colored papers, combinations of papers and plastic or metal films, having either uniform colors all over the surface of different colors for the raised portions and the background) to obtain multicolored effects and customize the wheel. Color differentiation may be also obtained by chemical or mechanical migration/reaction of pigments or materials within the body of the wheel, which may migrate in various manners to the side surfaces as a function of different densities or permeabilities of the lateral films.

The invention so conceived is susceptible of a number of changes and variants, within the inventive concept disclosed in the appended claims.

Furthermore, all the details may be replaced by other technically equivalent parts.

Any materials, shapes and sizes may be used in practice, depending on specific needs, without departure from the scope of the following claims.

The invention claimed is:

1. A cutting wheel, comprising:

a disk-shaped abrasive body (2) having two opposite faces (3) and having an extension of non-uniform thickness;

an aperture (4) at a center of the body and configured for fitting the body to a spindle;

plural raised ribbed profiles associated with each one of the faces, the profiles molded as one piece with the face, in plan view each profile being a zigzag shape extending in an essentially radial direction from the center of face, each profile having a substantially constant thickness of less than 0.001 meter, the profiles arranged in one of a succession i) with a substantially constant angular pitch, and ii) in symmetric sets;

a plurality of spaces configured for removing chips formed during cutting, the spaces located between the profiles defined by each face, the body having a diameter of 0.05 meter to 0.35 meter and a thickness up to 1/60 of the diameter; and an abrasive cutting material of non-uniform density distribution covering the body and the profiles, areas having a higher density of cutting material and hardness being more effective for cutting soft materials and areas having a lower density of cutting material being more effective for cutting harder materials.

2. The wheel of claim 1, wherein, the diameter of the body is one of 115 mm and 125 mm and the thickness of the body is up to 0.8 mm.

3. The wheel of claim 1, wherein, the abrasive material has a lower abrasive material density distribution on the profiles.

* * * * *